United States Patent [19]

Horie

[11] Patent Number: 4,696,247

[45] Date of Patent: Sep. 29, 1987

[54] FEED DEVICE FOR A SEWING MACHINE

[75] Inventor: Fujio Horie, Nagoya, Japan

[73] Assignee: Brother Kogyo Kabushiki Kaisha, Nagoya, Japan

[21] Appl. No.: 934,000

[22] Filed: Nov. 24, 1986

[30] Foreign Application Priority Data

Dec. 16, 1985 [JP] Japan ..... 60-283286

[51] Int. Cl.[4] ..... D05B 27/22

[52] U.S. Cl. ..... 112/315; 112/456

[58] Field of Search ..... 112/314, 303, 220, 277, 112/453, 455, 456, 323, 121.11, 121.12, 315

[56] References Cited

U.S. PATENT DOCUMENTS 4,236,469 12/1980 Takenoya et al. ..... 112/314 X 4,286,532 9/1981 Tonomura ..... 112/314

4,625,667 12/1986 Hammermann ..... 112/456

*Primary Examiner*—Peter Nerbun

[57] ABSTRACT

A feed device drives a feed dog directly by a stepping motor having a predetermined number P of excitation modes, and devised so that the output shaft thereof is turned by a unit amount S when the excitation mode is changed over. A stopper is disposed so as to define the range of the horizontal feed motion of the feed dog. An excitation control means excites the stepping motor in a specific excitation mode at the start or at the end of horizontal feed operation. The specific excitation mode is one of the excitation modes in which the stepping motor is excited while the output shaft thereof is turned by an amount P·S/2 from a position where the output shaft of the stepping motor is restrained from rotation by the stopper. When the step-out of the stepping motor occurs due to an excessive load acting through the feed dog on the stepping motor during stitching operation, the output shaft of the stepping motor is held at a predetermined angular position by the stopper, and then the stepping motor is excited in the specific excitation mode to restore the stepping motor to synchronism from step-out. Thus, the deformation of the pattern is limited to the least extent.

5 Claims, 18 Drawing Figures

FIG.15

| Data number | Excitation signal for the feed stepping motor | Excitation signal for the needle swinging stepping motor | |
|---|---|---|---|
| | a b c d | a b c d | |
| 1 | 1000 | 1000 | |
| 2 | 1000 | 0100 | |
| 3 | 1000 | 0010 | |
| ⋮ | ⋮ | ⋮ | |
| I | 1000 | 0100 | TS1 rise-up timing |
| I+1 | 0100 | 0010 | |
| I+2 | 0010 | 0010 | End of pulse distribution for needle swinging operation |
| I+3 | 0001 | 0010 | |
| I+4 | 1000 | 0010 | |
| I+5 | 0100 | 0010 | Completion of pulse distribution |
| I+6 | 0100 | 0010 | |
| ⋮ | ⋮ | ⋮ | |
| n−1 | 0100 | 0010 | |
| n | 0100 | 0010 | |

FIG.16

| Data number | Excitation signal for the feed stepping motor | Excitation signal for the needle swinging stepping motor | |
|---|---|---|---|
| | a b c d | a b c d | |
| 1 | 0 1 0 0 | 1 0 0 0 | |
| 2 | 0 1 0 0 | 0 1 0 0 | |
| 3 | 0 1 0 0 | 0 0 1 0 | |
| ⋮ | ⋮ | ⋮ | |
| I | 0 1 0 0 | 0 1 0 0 | TS1 rise-up timing |
| I+1 | 0 0 1 0 | 0 0 1 0 | |
| I+2 | 0 0 0 1 | 0 0 1 0 | Completion of pulse distribution for needle swinging operation |
| I+3 | 1 0 0 0 | 0 0 1 0 | |
| I+4 | 0 1 0 0 | 0 0 1 0 | |
| I+5 | 0 0 1 0 | 0 0 1 0 | Completion of pulse distribution |
| I+6 | 0 0 1 0 | 0 0 1 0 | |
| ⋮ | ⋮ | ⋮ | |
| n−1 | 0 0 1 0 | 0 0 1 0 | |
| n | 0 0 1 0 | 0 0 1 0 | |

FEED DEVICE FOR A SEWING MACHINE

BACKGROUND OF THE INVENTION

The present invention relates to a feed device for a sewing machine, for directly driving a feed dog with a stepping motor, capable of a function to prevent the asynchronism of the stepping motor.

The following three types of feed devices for sewing machines have been known.

A first feed device has a feed shaft driven by the main motor of the sewing machine, for driving the needle for vertical reciprocation. The feed per stroke and feed direction of the feed device are controlled by mechanically regulating a feed regulating device included in an interlocking mechanism for transmitting power from the upper shaft to the feed shaft, to regulate the amplitude of swing motion and phase of the interlocking mechanism relative to the rotation of the upper shaft.

A second feed device has a feed shaft driven by the main motor of the sewing machine. The feed per stroke and feed direction of the feed device are controlled electrically by driving a feed regulating device included in an interlocking mechanism interlocking the upper shaft and the feed shaft by a stepping motor or the like.

A third feed device has a feed shaft driven by an individual stepping motor provided in addition to the main motor. The rotation of the feed shaft, feed per stroke and feed direction are controlled by the stepping motor or the like.

The first and second feed devices have an advantage that a large feed force is available, because the feed shaft is driven for rotation by the main motor having a large torque. However, since the rotation of the upper shaft is converted into the rocking motion of a rod through an interlocking mechanism including a cam and a bifurcate link to rotate the feed shaft, the phase of the feed shaft relative to that of upper shaft is defined uniquely by the shape of the cam, and it is impossible to rotate the feed shaft through a large angle of rotation by the rotation of the upper shaft through a small angle of rotation due to restrictions on the mechanism, such as the limit of the pressure angle of the cam. That is, there is a tendency that the phase of the upper shaft at the start of the horizontal movement of the feed dog is advanced from an ideal phase, and the phase of the upper shaft at the end of the horizontal movement of the feed dog is retarded from an ideal phase. Consequently, it is possible that the feed motion is started before a stitch has firmly been tightened resulting in unsatisfactory tightening of the needle thread. Furthermore, in sewing a thick fabric, it is possible that the needle is thrusted into the fabric before the completion of the feed operation resulting in the breakage of the needle. Still further, since the constitution of the transmission mechanism interlocking the upper shaft and the feed device is complicated, the stitch pattern is deformed or irregular stitches are formed due to cumulative error in the transmission mechanism and enhancement of the cumulative error by friction betweeen the components of the transmission mechanism.

U.S. Pat. No. 4,286,532 discloses an improved device eliminated of the disadvantages of the foregoing conventional feed devices. This device drives the feed shaft directly for rotation by an individual stepping motor provided in addition to the main motor for driving the upper shaft. This device is designed to carry out the optional control of the feed operation by directly driving the stepping motor in an open loop control mode in synchronism with the upper shaft on the basis of the detected phase of the upper shaft. The optional control of the feed shaft enables the formation of complex patterns. In the open loop control mode, the stepping motor is controlled by commanding the relative angle of rotation by the number of stepping movement of the stepping motor. Accordingly, in operating the sewing machine, first the origin of the feed shaft is set, and then the number of command pulses is controlled on an assumption that the output shaft of the stepping motor rotates in correct response to the command pulses.

However, the open loop control of the stepping motor has a disadvantage that the step-out of the stepping motor occurs readily when an excessive load is applied to the stepping motor. Since the feed shaft rotates within a predetermined angular range, once the step-out of the stepping motor occurs, the absolute angle of the feed shaft becomes unknown, and the feed start angle and the feed stop angle are deviated from ideal angles in the direction of action of the load. Consequently, even after the excessive load has been removed, the control unit continues a predetermined control operation on an assumption that the step-out of the stepping motor never occurs. Therefore, when the feed shaft is required to be rotated through an angle corresponding to the number of command pulses in the normal or reverse direction, the angle of rotation of the feed shaft is restricted by the upper or lower limit of a predetermined angular range, which causes the stepping motor to step out. On the other hand, when the feed shaft restrained from rotation in one direction at the limit angle of the angular range due to the step-out of the stepping motor needs to be rotated in the opposite direction for return movement, in some cases, the direction of action of the torque of the stepping motor is reverse to the desired direction of rotation of the feed shaft depending on the mode of magnetization of the stepping motor. Consequently, the feed shaft is unable to rotate in synchronism with the command pulse signal given by the control unit. Thus, in such a state, the stepping motor is unable to respond to several initial pulses of the command pulse signal commanding the rotation of the output shaft of the stepping motor in the movable direction and, some times, the step-out of the stepping motor occurs. Accordingly, even after the excessive load has been removed, the step-out of the stepping motor occurs intermittently in part of the feed cycle until the origin of the feed shaft is determined, and hence the sewing machine is unable to from stitches corresponding to command signals.

In order to prevent the step-out of the stepping motor, an interlocking mechanism interlocking the feed dog through a spring with the output shaft of the stepping motor has been contrived to obviate the direct action of an excessive load working on the feed dog on the stepping motor. When this interlocking mechanism is employed, the torque of the stepping motor must be greater than the maximum working resilience of the spring. That is, the spring needs to have a small spring constant or the stepping motor needs to have a large torque capacity. However, when a spring having a small spring constant is employed, the synchronous operation of the feed dog with the rotation of the stepping motor is readily broken by a small load, and thereby a faulty pattern is stitched; and the torque capacity of the stepping motor is not utilized effectively.

Employment of a large stepping motor having a large torque capacity is disadvantageous in respect of weight and space.

SUMMARY OF THE INVENTION

Accordingly, it is an object of the present invention to provide a feed device provided with a stepping motor for directly driving the feed dog of a sewing machine, in which the stepping motor is controlled in an open loop control mode, capable of automatically restoring the stepping motor which has been caused to step out by an excessive load to synchronism, even while the sewing machine is operated continuously, upon the removal of the excessive load so that the sewing machine is able to form correct stitches.

The conceptional constitution of the present invention for solving the foregoing problems is shown in relation to other associated devices in FIG. 1.

A feed device for a sewing machine according to a first invention includes an endwise reciprocatable needle and feed means having a feed dog and operative to impart a horizontal feed motion and a vertical feed motion to said feed dog in timed relation with the reciprocation of said needle; wherein said feed means comprises, a stepping motor operatively connected with said feed dog for said horizontal feed motion and having excitation modes as many as a predetermined number P, said stepping motor being capable of shifting by a unit amount S when the excitation mode thereof is changed over from one to the next, stopper means disposed at a stoppage position corresponding to at least one of two limit positions defining the maximum range of said horizontal feed motion, and feed control means for controlling said horizontal feed motion by sequentially changing over the excitation modes of said stepping motor in response to signals instructing the feed distance of said feed dog, said feed control means including excitation control means for changing over the excitation mode of said stepping motor to a specific excitation mode at least at one of the start and the end of said horizontal feed motion, said specific excitation mode being predetermined from among the excitation modes to be changed over while said stepping motor shifts by an amount P·S/2 from a position where said stepping motor is positioned when the position of said feed dog is restricted to said stoppage position by said stopper means.

Said excitation control means preferably changes over excitation mode of said stepping motor to said specific excitation mode when said feed dog is below the upper surface of the bed of said sewing machine.

Said excitation control means preferably changes over the excitation mode of said stepping motor to said specific excitation mode in timed relation with every horizontal feed motion.

Said excitation control means preferably performs alternately the changeover to said specific excitation mode at the start of said horizontal feed motion and the changeover to said excitation mode at the end of said horizontal feed motion.

A feed device for sewing machine according to a second invention includes an endwise reciprocatable needle and feed means having a feed dog and operative to impart a horizontal feed motion and a vertical feed motion to said feed dog in timed relation with the reciprocation of said needle; wherein feed means comprises, a stepping motor operatively connected with said feed dog for said horizontal feed motion and having excitation modes as many as a predetermined number P, said stepping motor being capable of shifting by a unit amount S when the excitation mode thereof is changed over from one to the next a pair of stopper means disposed at a first and a second stoppage position corresponding to two limit positions defining the maximum range of said horizontal feed motion, and feed control means for controlling said horizontal feed motion by sequentially changing over the excitation modes of said stepping motor in response to signals instructing the feed distance of said feed dog, said feed control means including excitation control means for alternately performing the changeover to a first specific excitation mode at the start of said horizontal feed motion and changeover to a second specific excitation mode at the end of said horizontal feed motion, each of said first and second specific excitation mode being predetermined from among the excitation modes to be changed over while said stepping motor shifts by an amount P·S/2 from a position where said stepping motor is postioned when the position of said feed dog is restricted to each of said first and second stoppage position.

FIG. 3 shows conceptional diagrams representing the mode of operation of the feed dog, according to the present invention. In FIG. 3, P1 to P11 indicate the horizontal positions of the feed dog, respectively, and the pitch of the horizontal positions, namely, the interval between the adjacent horizontal positions, corresponds to the unit amount S of movement of the output shaft of the stepping motor. The stepping motor has four excitation modes Ea, Eb, Ec and Ed (P=4). Feed limit points PA and PB are positions where the feed dog is positioned when the movement (hereinafter referred to "rotation", assuming that the stepping motor is a rotary stepping motor) of the output shaft of the stepping motor is restricted by the stopper The relation of the horizontal positions P1 to P11 of the feed dog to the excitation modes Ea, Eb, Ec and Ed is shown in FIG. 3. The maximum amount of feed corresponds to ten pulses.

Referring to FIG. 3 (*a*), at the moment when the sewing machine is connected to a power source, the feed dog is positioned at an indefinite position. In stage C1, more than ten pulses are given to the stepping motor to rotate the output shaft of the stepping motor so that the feed dog is moved below the upper surface of the bed toward the feed limit point PA (the rotation of the output shaft of the stepping motor in such a direction will be referred to as "reverse rotation" hereinafter) by a distance greater than the maximum amount of feed. Then, the rotation of the output shaft of the stepping motor is restricted by a stopper, and hence the feed dog is stopped at the feed limit point PA, so that the stepping motor is caused to step out. In this state, the position of the feed dog is dependent on the the excitation mode of the stepping motor after the rotation of the output shaft of the stepping motor has been restricted by the stopper. When the final excitation mode is Ea or Eb, the feed dog is positioned at a position P1 or P2, respectively. When the excitation mode is Ec or Ed, the torque of the stepping motor acts in a direction to urge the feed dog toward the feed limit point PA, and thereby the feed dog is positioned at the feed limit point PA.

When the stepping motor is energized in the specific excitation mode Ea with the feed dog positioned at the feed limit point PA, the feed dog is positioned at the point P1 in stage C2.

Then, while the feed dog is protruding from the upper surface of the bed and the stepping motor is energized in the excitation mode Ea, the stepping motor is energized sequentially in the excitation modes to rotate the output shaft of the stepping motor in a direction to move the feed dog toward the feed limit point PB (the rotation of the output shaft of the stepping motor in such a direction will be referred to as "normal rotation" hereinafter) by a distance corresponding to a feed data for a stitch pattern. Then, in stage C3, the horizontal movement of the feed dog is started to feed the fabric. After the feed dog has been retracted below the upper surface of the bed at the point P6, where the feed motion of the feed dog is terminated, the output shaft of the stepping motor is driven for the reverse rotation to move the feed dog in the reverse direction by a distance corresponding to the foregoing feed data, whereby the feed dog is returned to the starting point P1 in stage C4. Thus, the feed motion in stage C3 and the return motion in stage C4 are repeated according to the feed data to form stitches continuously.

A mode of the excitation control means, which is an essential component of the present invention, is characterized in employing the excitation mode for starting the feed operation of stage C3 as the specific excitation mode (Ea or Eb) and in starting the feed motion from the point P1 or P2. To drive the stepping motor in synchronism with a first excitation signal from a state in which the feed dog is positioned at the feed limit point PA and the rotation of the output shaft of the stepping motor is restrained by the stopper, there is a restriction on the type of the excitation mode. That is, if the stepping motor is excited in the excitation mode Ea, the torque of the stepping motor acts in the direction corresponding to the normal rotation, so that the feed dog is positioned at the point P1. If the stepping motor is excited in the excitation mode Eb, the torque of the stepping motor acts also in the direction corresponding to the normal rotation, so that the feed dog is positioned accurately at the point P2. However, if the stepping motor is excited in the excitation mode Ec or Ed, the stepping motor produces a torque acting in the direction of reverse rotation, whereby the feed dog is held at the feed limit point PA. Since the order of the excitation modes for driving the stepping motor for normal rotation is Ea-Eb-Ec-Ed-Ea, the stepping motor does not respond to the initial two excitation modes Ec and Ed when a series of the excitation modes is started from the excitation mode Ec. That is, the stepping motor is in a step-out state while the initial two pulses are given, and hence the output shaft of the stepping motor is unable to rotate through an angle corresponding to the number of the command pulses.

Suppose that an excessive load is working on the feed dog in a direction toward the feed limit point PA, the step-out of the stepping motor occurs in the stage C3, and hence the stepping motor is uanble to drive the feed dog by a distance corresponding to the number of command steps. Accordingly, the feed dog is restrained at the feed limit point PA or is positioned at a position before a normal feed end point near the feed limit point PA, at the end of the control operation for stage C3. Therefore, the actual number of steps in the return movement in stage C4 is smaller than the number of command steps, and hence the rotation of the output shaft of the stepping motor is restrained by the stopper, and the stepping motor steps out.

However, when the feed operation is started always from the specific excitation mode, the feed start position of the feed dog is determined at a position (point P1, in this example) corresponding to the specific excitation mode from the beginning of the first feed cycle after the removal of the excessive load, and hence the output shaft of the stepping motor is able to rotate in synchronism with the excitation signal from the first excitation signal, the output shaft is able to rotate by steps as many as the command steps, and the stepping motor is restored automatically from step-out to synchronism.

As is readily understood from the foregoing description, when the stepping motor is excited in the specific excitation mode, the output shaft, hence, the rotor, of the stepping motor is rotated from a position where the output shaft is restrained from rotation by the stopper to a position corresponding to the specific excitation mode and is positioned accurately at the same position. When the feed limit point PA is located as shown in FIG. 3, the excitation modes Ea and Eb are the specific excitation modes. Generally, the specific excitation mode is such an excitation mode for positioning the output shaft of the stepping motor at a position, more specifically, at an angular position, before a position where the output shaft is restrained from rotation by the stopper by an angular distance $P \cdot S/2$, where P is the number of the excitation modes, and S is the angular pitch of the stepping motion of the stepping rotation of the output shaft, hence, the rotor, of the stepping motor. When the stepping motor is excited in this excitation mode, the rotor of the stepping motor is turned from a position where the output shaft of the stepping motor is restrained from rotation by the stopper to a position corresponding to the excitation mode.

As illustrated in FIGS. 3 (*b*) and 3 (*d*), in another feed control mode, the starting position of a feed cycle is determined on the basis of feed data for the next feed cycle so that the last excitation mode in a feed stage C8 is one of the specific excitation modes Ec and Eb. When the specific excitation mode is thus determined, the output shaft of the stepping motor can be rotated from a position where the output shaft is restrained from rotation by the stopper to a position corresponding to the specific excitation mode and is positioned accurately at the same position. The specific excitation mode is Ec in FIG. 3 (*b*), and Eb in FIG. 3 (*d*). This mode of control is effective when an excessive load acts on the feed dog in a direction toward the feed limit point PB. When overloaded, the stepping motor steps out in the stage C8. However, since the feed cycle terminates when the stepping motor is in the specific excitation mode, the starting point of the return stage C7 in which the stepping motor is not loaded is determined accurately at a predetermined position corresponding to the specific excitation mode (P11 or P10). Accordingly, the return stage C7 can be carried out without the step-out of the stepping motor, and hence a commanded feed starting position can be determined accurately. Therefore, the stepping motor is restored from step-out to synchronism at the beginning of the first feed stage C8 after the removal of the excessive load, and is able to execute feed operation corresponding to the number of command steps.

As illustrated in FIG. 3 (*e*) in a further feed control mode, the above-mentioned two feed control modes are repeated alternately. That is, one cycle of control operation in this feed control mode includes starting feed stage C22 with the stepping motor in the specific excitation mode Ea or Eb, determining the feed starting position of the next feed stage C24 on the basis of the next feed data so that the next feed stage C24 is terminated when the stepping motor is in the specific excitation mode Ec or Eb, while the feed dog is lowered below the upper surface of the bed after the completion of the feed stage C22, positioning the feed dog at the feed starting position (stage C23), executing the stage C24, and executing return stage C25 for returning the feed dog to a position corresponding to the specific excitation mode for starting the feed stage C22. In this control mode, even when the stepping motor is overloaded in any direction, in a direction toward either the feed limit point PA or PB, the stepping motor is restored from step-out to synchronism in the next control cycle, and thereby feed control operation for normal amount of feed is continued.

According to the present invention, the excitation mode of the stepping motor at the start or end of the horizontal movement of the feed dog is controlled so as to be a specific excitation mode to shift the output shaft of the stepping motor from a position where the output shaft is restrained from rotation by the stopper to a specific position specified by an excitation mode. Consequently, the starting position or the ending position of each feed cycle can be fixed at a specific position specified by the specific excitation mode. Accordingly, the stepping motor responds to the first excitation signal after the removal of the excessive load and the output shaft of the stepping motor is positioned accurately at the position specified by the specific excitation mode, and hence the output shaft can be rotated in response to the following command signal by steps corresponding to the command signal without step-out. Thus, the present invention controls the deformation of stitch patterns to the least extent.

DESCRIPTION OF THE DRAWINGS

FIG. 15 is a table of excitation signal data produced by the first embodiment of the present invention; and FIG. 16 is a table of excitation signal data produced by the second embodiment of the present invention.

DESCRIPTION OF THE PREFERRED EMBODIMENTS

Preferred embodiments of the present invention will be described hereinafter with reference to the accompanying drawings.

Figure 1:
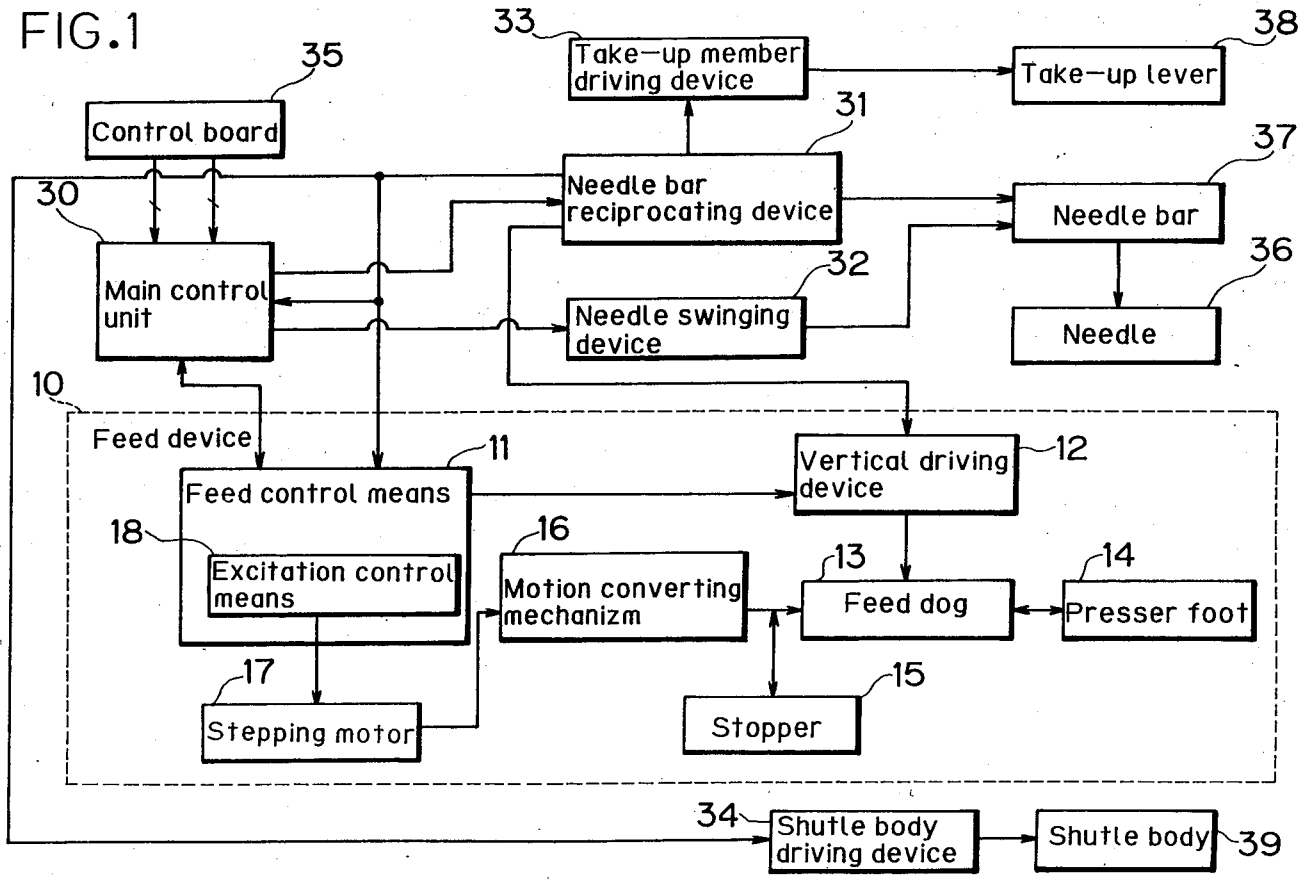
FIG. 1 is a block diagram showing the conceptional constitution of a feed device according to the present invention in conjunction with the associated devices.
Figure 2:
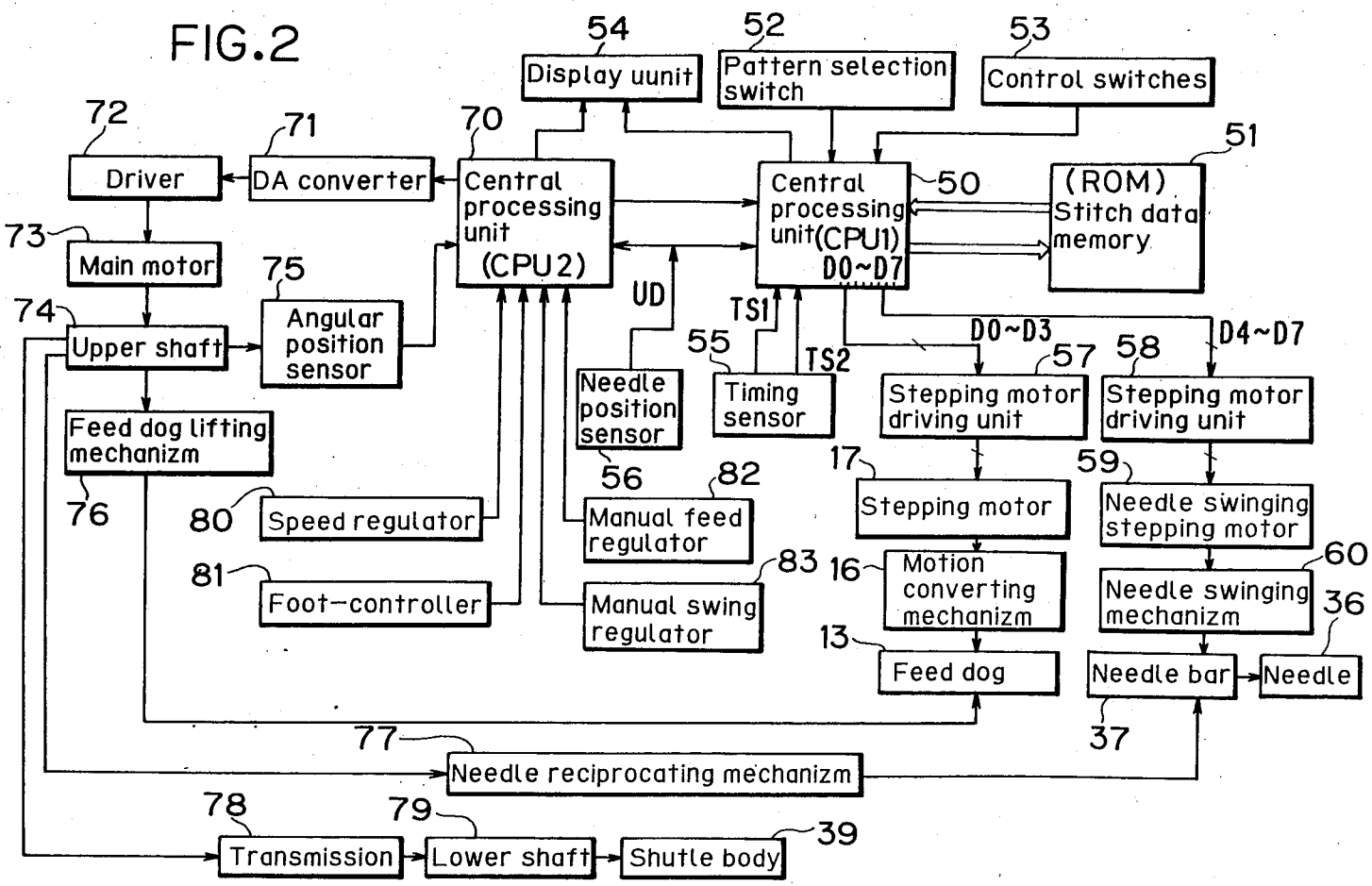
FIG. 2 is a block diagram showing the constitution of a feed device, in a first embodiment, according to the present invention in conjunction with the associated devices.

FIG. 2 is a block diagram showing the general constitution of a sewing machine equipped with a feed device embodying the present invention.

A central processing unit 50 (CPU 1) and a central processing unit 70 (CPU 2) correspond to a main control unit 30 and a feed control unit 11, respectively. A DA converter 71 is connected to the output port of the CPU 2; a driver 72 is connected to the DA converter 71; and a main motor 73 is connected to the driver 72. The CPU 2 provides a command signal to drive the main motor 73 at a command speed. The main motor 73 drives an upper shaft 74 for rotation.

An angular position sensor 75 is associated with the upper shaft 74 to detect the phase angle of the upper shaft 74. The output signal of the angular position sensor 75 is applied to the CPU 2. The rotary motion of the upper shaft 74 is converted into a reciprocative motion by a feed dog lifting mechanism 76 to move the feed dog 13 vertically with respect to the upper surface of a bed 2 in synchronism with the upper shaft 74. A needle reciprocating mechanism 77 is connected to the upper shaft 74 to reciprocate a needle bar 37 vertically by the upper shaft 74. A transmission 78 transmits the rotative force of the upper shaft 74 to a lower shaft 79 to rotate a shuttle body 39 in synchronism with the upper shaft 74.

A speed regulator 80 for regulating the stitching speed, and a foot-controller 81 for controlling the stitching speed by means of a footswitch are connected to the CPU 2. Also connected to the CPU 2 are a manual feed regulator 82 for regulating the pitch of stitches, and a manual swing regulator 83 for regulating the amplitude of the swing motion of the needle bar 37 for stitching zigzag patterns. The output signal of a needle position sensor 56 for detecting the vertical position of the needle 36 is applied to the CPU 2. The needle position sensor 56 is associated with the upper shaft 74. A display unit 54 for displaying various operating conditions is connected to the CPU 2.

A pattern selection switch 52 for selecting a pattern, control switches 53 for giving various control instructions, and a display unit 54 for indicating various control modes are connected to the CPU 1. A stitch data memory 51 storing stitch data including feed distances and swing amplitudes for each pattern is connected to the CPU 1. The CPU 1 provides an address signal to read the stitch data. Also connected to the CPU 1 are the needle position sensor 56 and a timing sensor 55 associated with the upper shaft 74, for providing a timing signal at a particular phase angle of the upper shaft 74.

Stepping motor driving units 57 and 58 are connected to the output port of the CPU 1. The stepping motor driving units 57 and 58 are controlled by four-bit signals D0 to D3, and by four-bit signals D4 to D7, respectively. The stepping motor driving unit 57 drives a feed driving stepping motor 17 for horizontally driving the feed dog 13 through a feed driving mechanism 16. The feed driving mechanism 16 comprises a cam, links and shafts, for converting the rotative motion of the stepping motor 17 into the horizontal motion of the feed dog 13. The stepping motor driving unit 58 drives a needle swinging stepping motor 59 for swinging the needle 36. The needle swinging stepping motor 59 drives the needle bar 37 for swing motion through a needle swinging mechanism 60, which comprises a cam and links, for converting the rotative motion of the stepping motor 59 into the swing motion of the needle bar 37.

Figure 5:
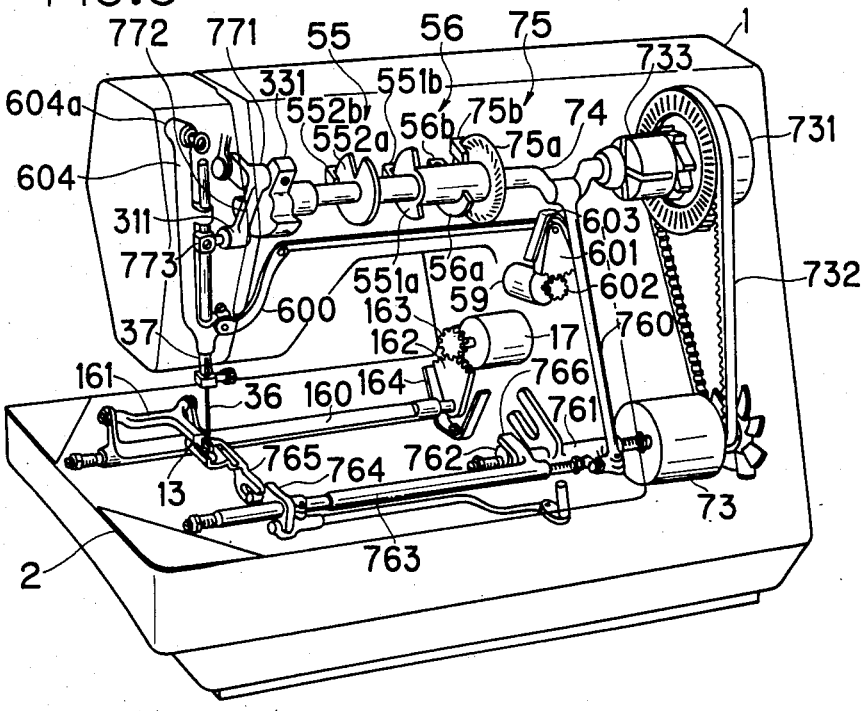
FIG. 5 is a perspective view of a sewing machine equipped with the feed device of FIG. 2.

In FIG. 5 showing the mechanical constitution of a sewing machine, indicated at 1 is a housing and at 2 is a bed. The main motor 73 is disposed in the lower part of the housing 1. The rotative force of the main motor 73 is transmitted through a driving belt 732 to a pulley 73. The pulley 731 is interlocked with the main shaft 74 by means of a clutch mechanism 733. The angular position sensor 75, the needle position sensor 56 and the timing sensor 55 are associated with the main shaft 74.

Figure 7:
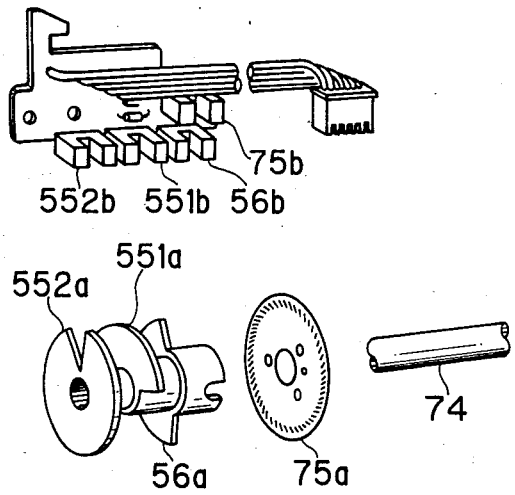
FIG. 7 is a perspective view showing the respective constitutions of an angular position sensor, a needle position sensor and a timing sensor.

As illustrated in FIG. 7, the angular position sensor 75 comprises a rotary disk 75*a* having slits arranged at minute angular intervals, and a photointerrupter 75*b* which receives the light that travels through the slits. The needle position sensor 56 comprises a sectoral shutter 56*a* having a predetermined central angle, and a photointerrupter 56*b* receiving the sectoral shutter 56*a* between the arms thereof to detect the interruption of light beam by the sectoral shutter 56*a*. The timing sensor 55 comprises sectoral shutters 551*a* and 552*a* having openings of predetermined central angles to provide timing signals TS1 and TS2, respectively, and photointerrupters 551*b* and 552*b* which receive the light modulated by the sectoral shutters 551*a* and 552*a*, respectively. The rectangular pulse output signals of the photointerrupters are given to the CPU 1 and the CPU 2.

Referring again to FIG. 5, a needle bar crank 771 is connected to the upper shaft 74, while a needle bar connecting link 772 is connected to the needle bar crank 771. The needle bar connecting link 772 is connected to a needle bar connecting stud 773 holding the needle bar 37. A thread take-up crank 331 is connected to the upper shaft 74 to reciprocate a take-up lever, not shown, vertically. A needle reciprocating mechanism 77 thus constituted converts the rotative motion of the upper shaft 74 driven by the main motor 73 into the vertical motion of the needle bar 37.

The needle bar 37 is held slidably by a needle bar holder 604. A needle swing link 600 has one end joined to the needle bar holder 604 and the other end connected to a sector gear 601 engaging a pinion 602 fixed to the output shaft of the stepping motor 59. The angular range of the swing motion of the sector gear 601 is defined by a V-shaped stopper 603. The sector gear 601 is turned in opposite directions by the stepping motor 59. The sector gear 601 drives the needle bar holder 604 through the needle swing link 600 to make the needle bar holder 604 swing on a pivot 604*a*. The rotative motion of the stepping motor 59 is converted into the swing motion of the needle 36 by the needle swinging mechanism 60 to control the needle 36 for swing motion.

A connecting rod 760 is connected to the upper shaft 74 to transmit the rotative force of the upper shaft 74 to a rocker arm 761. The rocking motion of the rocker arm 761 is transmitted through a cam 762 engaging the rocker arm 761 to a feed lifting rocking shaft 763 having a bifurcate arm 766. A feed lifting rocking shaft crank 764 is connected to the feed lifting rocking shaft 763, and is in engagement with a feed bar 765 having a bifurcate arm 764. Essentially, the feed dog lifting mechanism 76 has the above-mentioned constitution. The feed dog lifting mechanism 76 converts the rotative motion of the upper shaft 74 into the rocking motion of the feed lifting locking shaft 763 to drive the feed bar 765 for vertical movement.

A feed dog 13 is provided on the feed bar 765, and is connected to a feed shaft 160 with a rod 161. A sector gear 162 engaging a pinion 163 fixed to the output shaft of the stepping motor 17 is fixed to one end of the feed shaft 160. A V-shaped stopper 164 defines the range of the turning motion of the sector gear 162. Essentially, the feed driving mechanism 16 is thus constituted. The rotative motion of the stepping motor 17 is converted into the rocking motion of the feed shaft 160 by the sector gear 162 to move the feed dog 13 in horizontal directions.

Figure 6:
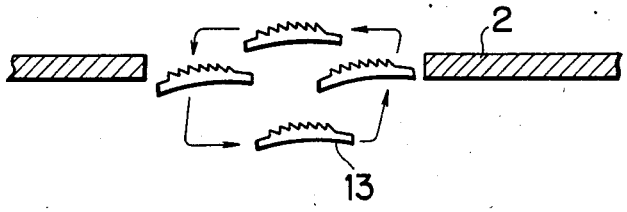
FIG. 6 is an illustration of assistance in explaining the feed motion of the feed dog.
Figure 8:
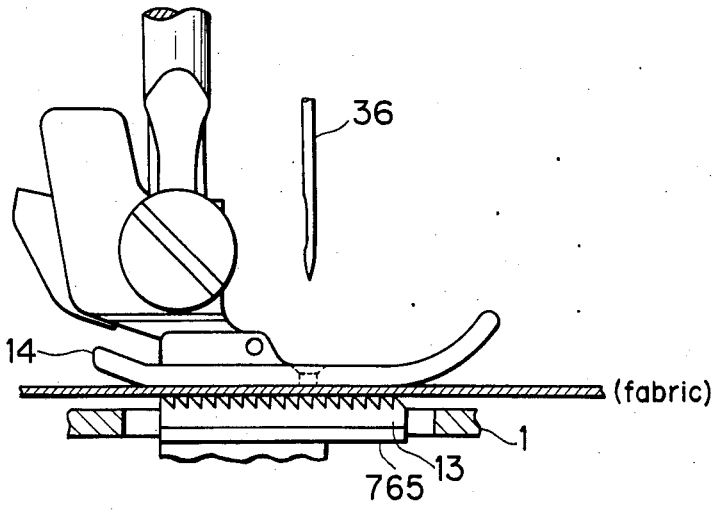
FIG. 8 is a side elevation of a fabric feed mechanism.

The feed dog lifting mechanism 76 and the feed driving mechanism 16 drive the feed dog 13 for a cyclic motion as illustrated in FIG. 6. Consequently, the fabric held between the feed dog 13 and the presser foot 14 is fed in a predetermined direction by the cooperative action of the feed dog 13 and the presser foot 14 as illustrated in FIG. 8.

Figure 9A:
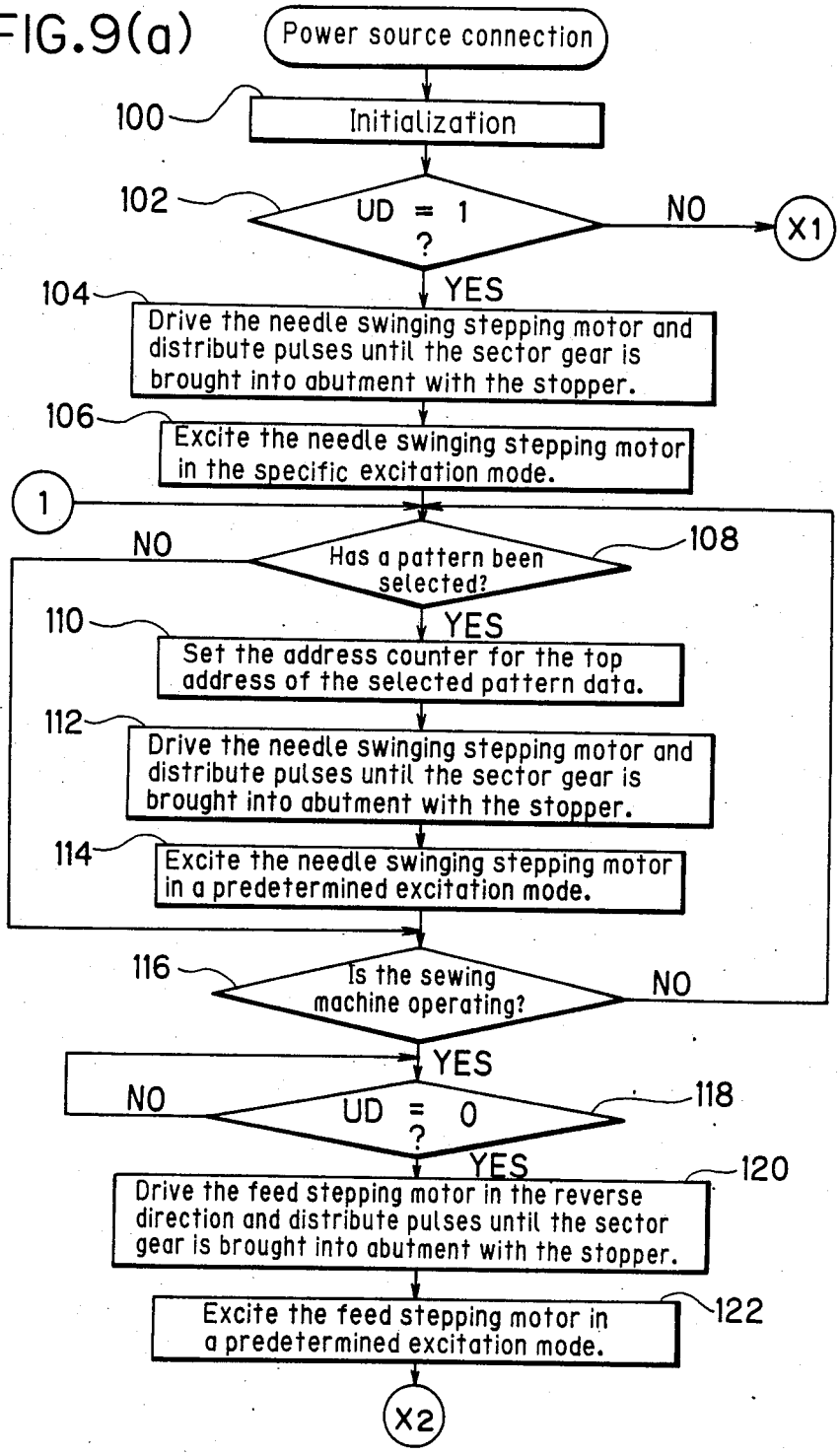
FIGS. 9 (*a*), 9 (*b*), 10 and 11 are flow charts of control routines to be executed by a CPU incorporated into the first embodiment of the present invention.
Figure 9B:
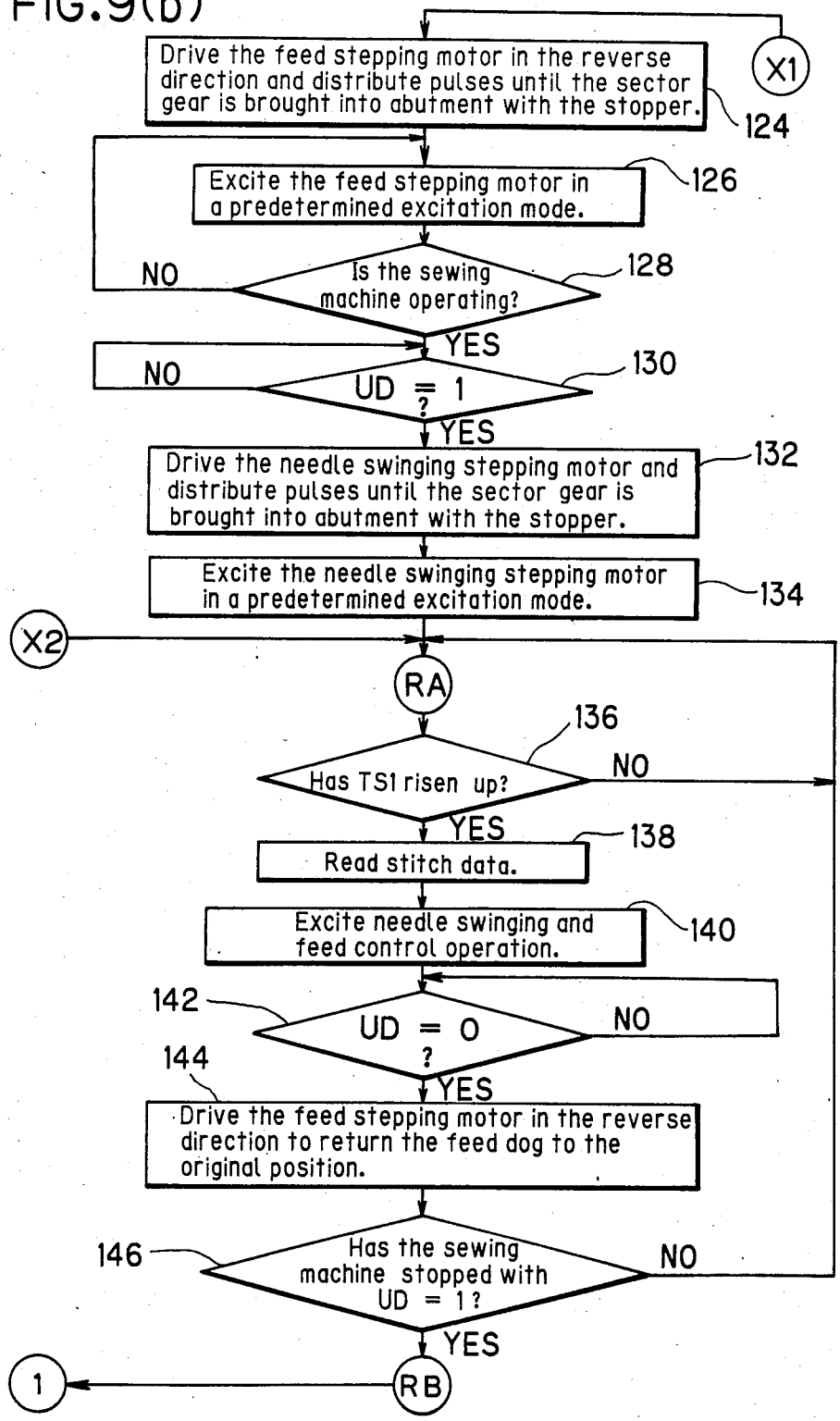
Figure 10:
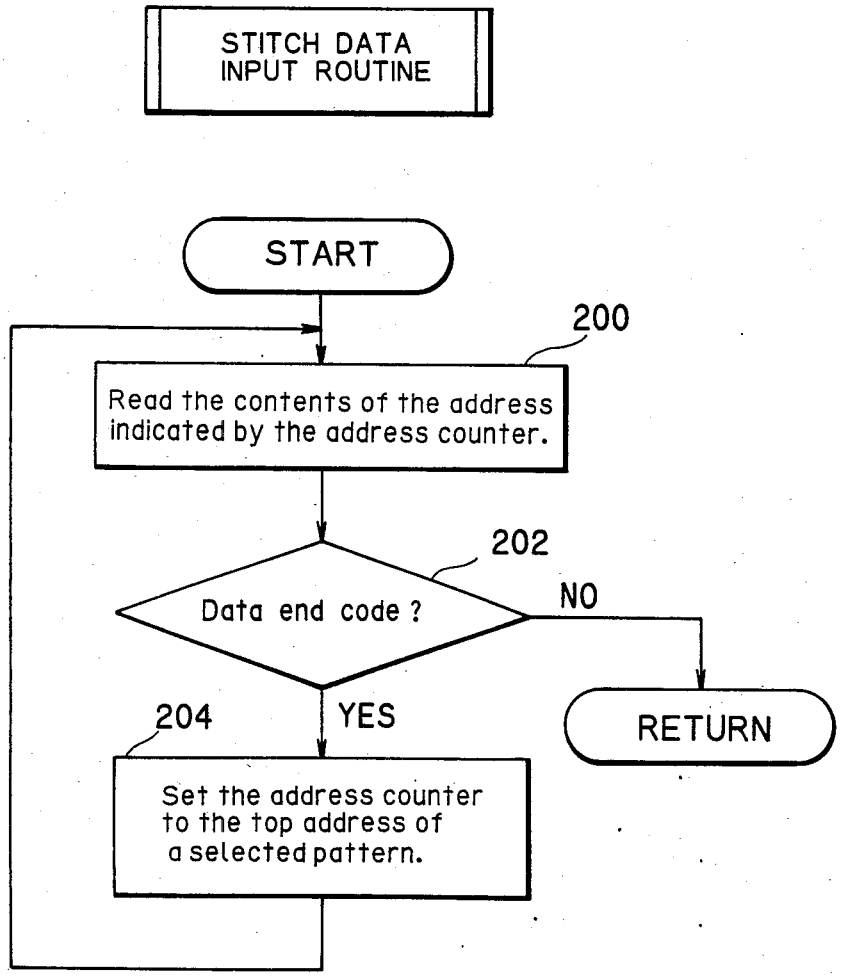
Figure 11:
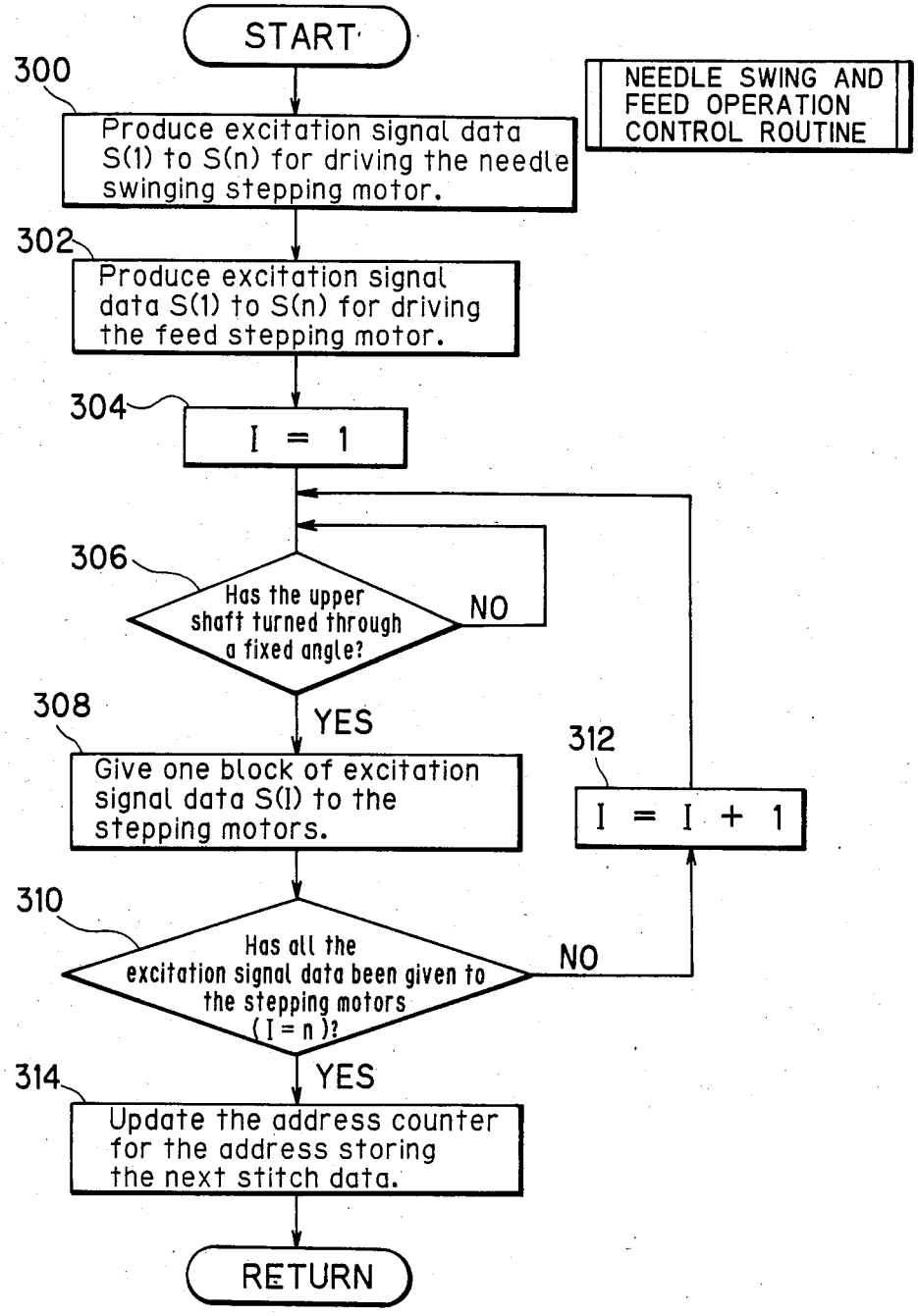

The operations of the feed device embodying the present invention will be described hereinafter with reference to FIGS. 3 (*a*) to 3 (*e*) typically illustrating the mode of motion of the feed dog, FIGS. 4 (*a*) to 4 (*e*) diagrammatically showing the motion of the feed dog 13 in relation to the associated components of the sewing machine, and FIGS. 9, 10 and 11 showing the flow charts of the control routines of the CPU's.

Upon the connection of the sewing machine to the power source, the control unit is initialized at step 100; for example, a straight stitching mode is selected and the address counter for reading the stitch data is set for the top address of a range storing straight stitch pattern data. At step 102, the output signal of the needle position sensor 56 is read and a decision is made as to whether or not the signal level of the output signal of the needle position sensor 56 is "1". The needle position sensor 56 detects the up and down positions of the needle 36, with respect to the upper surface of the fabric and provides a detection signal having a waveform shown in FIG. 4 (*c*). When the needle 36 is at the up position, the decision at step 102 is YES, namely, the signal level of the output signal of the needle position sensor 56 is "1", and then the routine advances to step 104, where the needle swinging stepping motor 59 is driven so that the output shaft thereof is turned toward the origin and pulse distribution is performed until the sector gear 601 is brought into abutment with the stopper 603. At step 106, after the sector gear 601 has been brought into abutment with the stopper 603, the stepping motor 59 is excited in the predetermined specific excitation mode. Then, at step 108, a decision is made as to the condition of the pattern selection switch 52. When a stitch pattern is selected, the routine advances to step 110, where the address counter is initialized for the top address of a range storing the selected stitch pattern data. Then, the needle 36 is swung through procedures similar to those of the steps 104 and 106 to set the needle 36 at the origin and to excite the stepping motor 59 in the predetermined specific excitation mode. Then, at step 116, a decision is made as to whether or not the sewing machine is operating, on the basis of the output signal of the phase angle sensor 75, which detects the rotation of the upper shaft 74. That is, the CPU 1 makes a decision as to whether or not the upper shaft 74 is rotating, on the basis of data given thereto from the CPU 2. When the sewing machine is operating, the routine advances to step 118. The step 118 is repeated until the signal level of the output signal of the needle position sensor 56 becomes "0". At a time t3 (FIG. 4 (*c*)), the needle 36 is moved to the down position, and hence the signal level of the output signal of the needle position sensor 56 becomes "0". Thereafter, the feed dog 13 is located below the upper surface of the bed 2 as illustrated in FIG. 4 (*a*). Accordingly, at step 120, the stepping motor 17 is driven so that the output shaft thereof is turned in the reverse direction to move the feed dog 13 backward, and pulse distribution is performed until the sector gear 162 is brought into abutment with the stopper 164. Then, at step 122, the stepping motor 17 is excited in the specific excitation mode.

When it is decided at step 102 that the needle 36 is at the down position, the routine goes to step 124, where the stepping motor 17 is driven so that the output shaft thereof is turned in the reverse direction until the sector gear 162 is brought into abutment with the stopper 164, and then the stepping motor 17 is excited in the specific excitation mode to set the feed dog 13 at the feed origin, through procedures similar to those of the steps 120 and 122. That is, as illustrated in FIG. 3 (*a*), the feed dog 13 is moved toward the feed limit point PA corresponding to a position where the sector gear 162 is in abutment with the stopper 164 (stage C1), and then the stepping motor 17 is excited in the specific excitation mode Ea to position the feed dog 13 at the point P1 (stage C2). Then, steps 126 and 128 are repeated until it is decided at step 128 that the sewing machine is in operation. When the sewing machine is started, the routine advances to step 130. At step 130, a decision is made as to whether or not the signal level of the output signal of the needle position sensor 56 is "1" When the decision at step 130 is YES (a timer t5), the routine advances to step 132. That is, since the needle 36 is moved to the up position, the needle 36 is set at the origin through procedures similar to those of steps 104 and 106.

While the sewing machine is operated continuously, a loop including steps 136 to 146 is repeated. When it is decided at step 146 that the sewing machine is stopped with the needle 36 at the up position, the routine returns to the step 108, where a decision is made as to whether or not a stitch pattern selecting operation is executed.

While the sewing machine is operated continuously, a decision is made at step 136 as to whether or not the output signal TS1 of the timing sensor 55 has fallen. When the decision at the step 136 is YES (a time t1 to t6), the routine advances to step 138. At this time, the feed dog 13 is located above the upper surface of the bed 2. At the step 138, the stitch data is read from the stitch data memory 51. FIG. 10 is a flow chart of a control routine for reading the stitch data. At step 200, data stored at an address instruced by the address counter is read. At step 202, a decision is made as to whether or not a data end code is read. When the decision at the step 202 is YES, the address counter is set for the top address of the stitch data of the selected pattern, and then the routine returns to the step 200 to read the contents of the stitch data. Thus, the control routine is repeated periodically to read the stitch data sequentially. Then, at the step 140, needle swinging operation and feed operation are controlled on the basis of the data which has just been read.

FIG. 11 is a flow chart of a control routine for controlling the needle swinging operation and feed operation. The stitch data includes the number of driving steps for the stepping motor 59 for swinging the needle, and the number of driving steps for the stepping motor 17 for feed operation, for each stitch. At steps 300 and 302, excitation signal data for turning the respective output shafts of the stepping motor 59 and the stepping motor 17 by steps as many as a number specified in the stitch data are produced, respectively. The stepping motors 17 and 59 are four-phase excitation stepping motors. Accordingly, the excitation signals are four-bit signals corresponding to the four excitation phases, respectively, in which bit "1" represents an excitation phase. As shown in FIG. 15, the excitation signal data is produced for data numbers 1 to n. As will be described below, the excitation signal data is provided for every rotation through a fixed angle of the upper shaft 74, and hence the data as many as a number "n" correspond to a fixed angular range of rotation of the upper shaft 74. Accordingly, the horizontal position of the feed dog 13 and the transverse position of the needle 36 can optionally be determined by producing the excitation data by optionally using the n divisions of the fixed angular range, and thereby the feed speed relative to the rotating speed of the upper shaft 74 can be regulated. For example, when a thick fabric is sewn on the sewing machine, feed timing can be varied according to the thickness of the fabric by producing the excitation signals for exciting the stepping motor 17 for horizontally driving the feed dog 13 from that corresponding to larger data numbers. The feed speed of the feed dog 13 relative to the rotating speed of the upper shaft 74 can be increased by increasing the variation of the excitation signal relative to the variation of the data number. In the case of the data shown in FIG. 15, the period of the excitation signals is the shortest in order that the feed dog 13 is moved at the maximum speed.

The timing of starting the excitation of the stepping motor 17 for feed operation is delayed from the timing of starting the excitation of the stepping motor 59 for swinging the needle. The timing of starting the excitation of the stepping motor 17 excited in the specific excitation mode is in phase with the rising time of the output signal TS1 of the timing sensor 55 under the ordinary feed control condition. That is, the fabric is fed after the needle thread has sufficiently been tightened.

The excitation signal data thus produced is given to the stepping motor driving units 57 and 58 through the following control steps. At step 304, a parameter I is set; at step 306, a decision is made on the basis of the output signal of the angular position sensor 75 as to whether or not the upper shaft 74 has turned through a fixed angle. When the decision at the step 306 is YES, one block of the excitation signal data S(I) shown in FIG. 15 is given to the stepping motor driving units 57 and 58 at step 308. At step 310, a decision is made as to whether or not all the excitation signal data have been given to the stepping motor driving units 57 and 58. When the decision at the step 310 is NO, the value of I is updated by one at step 312, and then the routine returns to the step 306. The stepping motors 17 and 59 are driven in synchronism with the upper shaft 74 by thus giving the excitation signal block by block to the stepping motor driving units. After the excitation signal data have been given to the stepping motor driving units 57 and 58, the address counter is addressed to an address storing the next stitch data at step 314. Thus, the feed control operation for one stitch is completed (stage C3).

Referring again to FIG. 9, at the step 142, a decision is made as to the signal level of the output signal of the needle position sensor 56. When the signal level of the output signal of the needle position sensor 56 changes to "0" (a time t8), the routine advances to step 144. At this time, the feed dog 13 is located below the upper surface of the bed 2. Then, the stepping motor 17 for driving the feed dog 13 for feed motion is driven so that the output shaft thereof is turned in the reverse direction by steps as many as those for the previous feed motion to return the feed dog 13 to the original position P1 (stage C4).

Thus, these control steps are repeated to repeat the feed stage C3 and the return stage C4, so that the fabric is fed. During the feed operation, the stepping motor 17 is excited always in the specific excitation mode Ea at the start of the feed motion. Accordingly, even when the step out of the stepping motor 17 occurs due to an excessive load that acts toward the feed limit point PA, the stepping motor 17 is able to respond to the first excitation signal, and hence the stepping motor 17 is synchronized immediately with the upper shaft 74. Consequently, the deformation of the stitch pattern is controlled to the least extent.

A feed device, in a second embodiment, according to the present invention will be described hereinafter.

Figure 3:
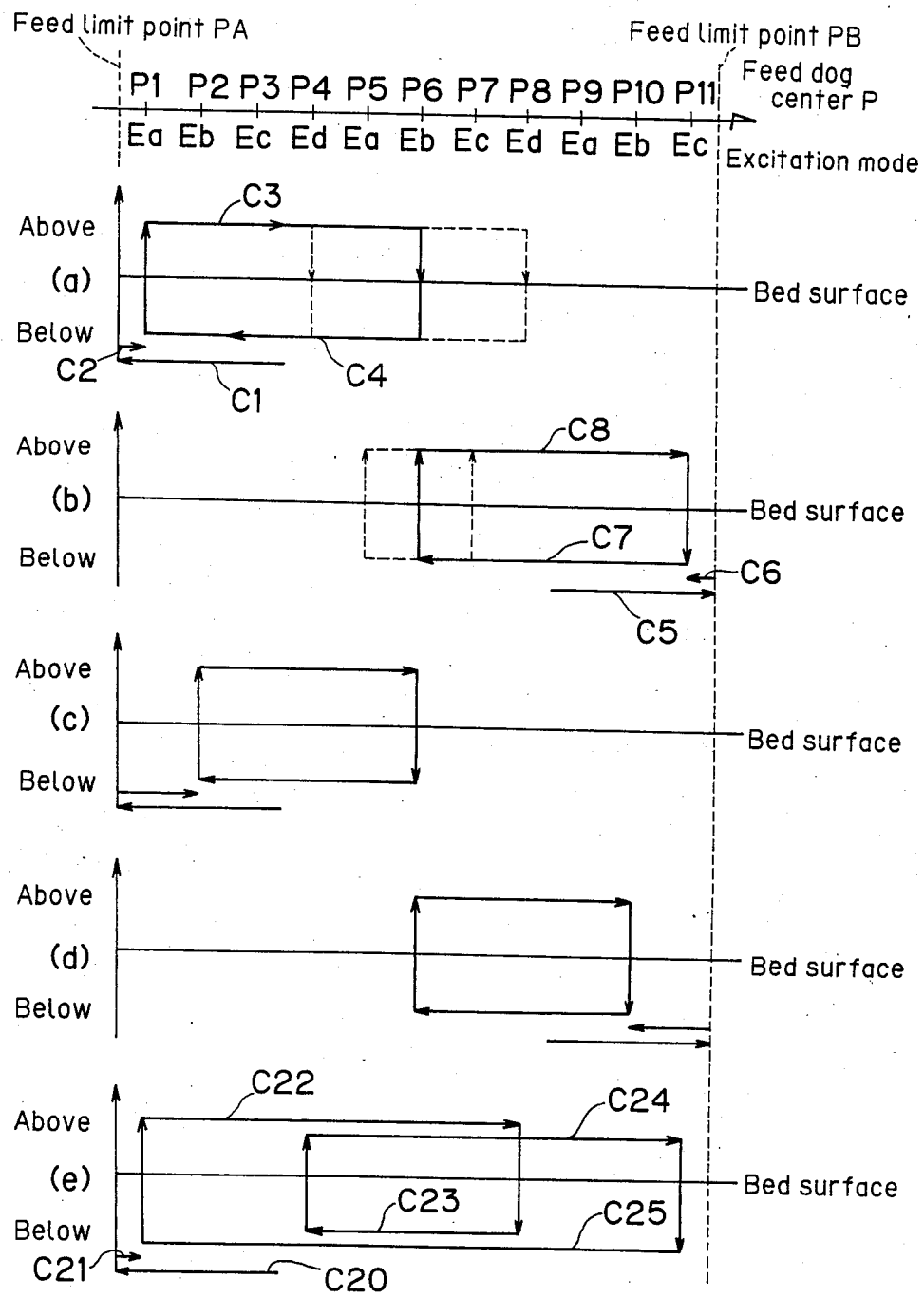
FIG. 3 (*a*) to 3 (*e*) are diagrams of assistance in explaining the manner of feed dog control operation.
Figure 4:
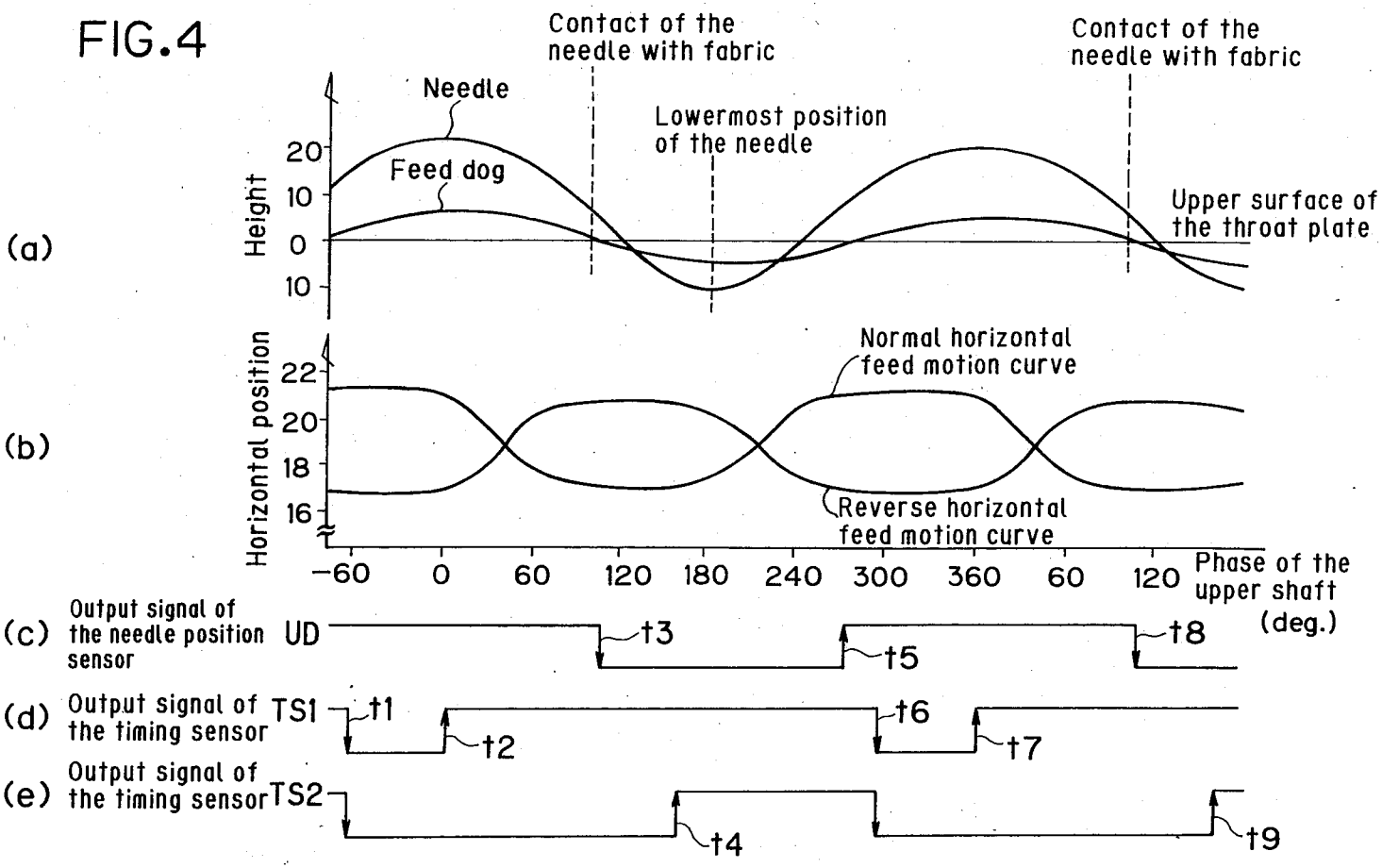
FIGS. 4 (*a*) to 4 (*e*) are diagrams of assistance in explaining the manner of operation of the feed device of FIG. 2.
Figure 12A:
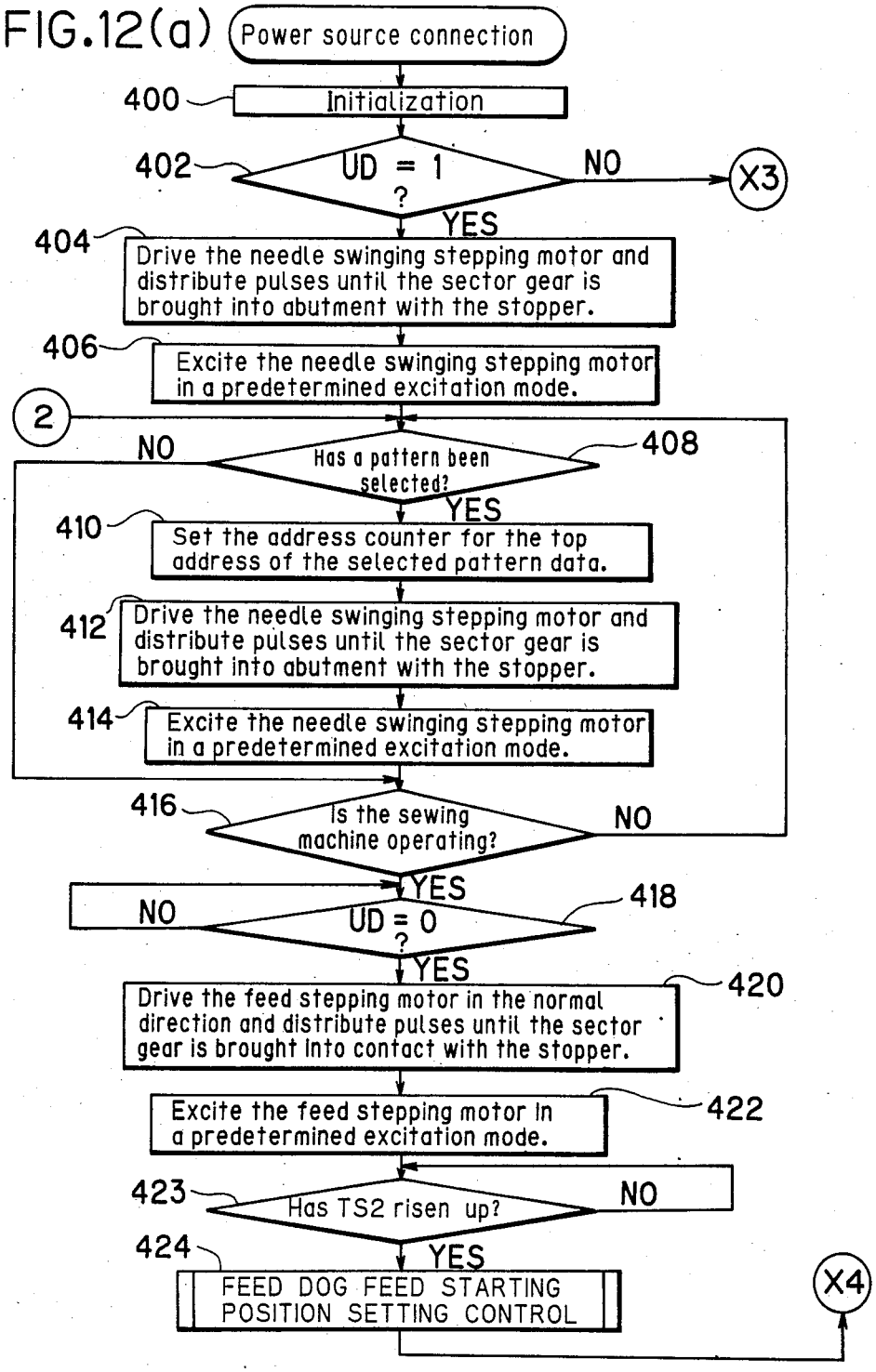
FIGS. 12 (*a*), 12 (*b*) and 13 are flow charts of control routines to be executed by a CPU incorporated into a second embodiment of the present invention.
Figure 12B:
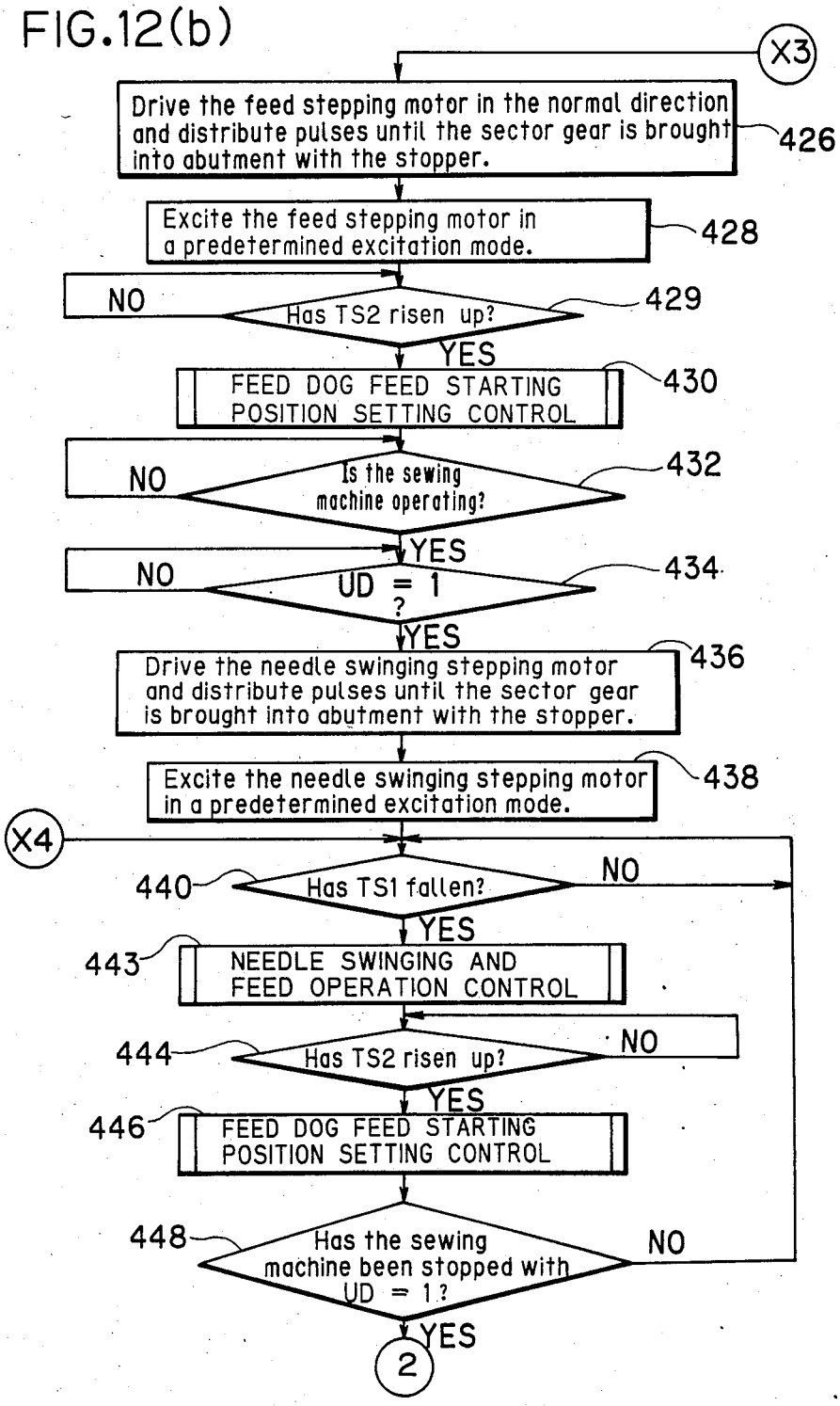

In the second embodiment, excitation signal data is produced so that the stepping motor 17 is excited in the specific excitation mode Ec at the end of a feed operation as illustrated in FIG. 3 (*b*). A control routine for such a feed operation is shown in FIG. 12. The manner of setting the needle 36 at the original position is the same as that of the first embodiment, and hence the description thereof will be omitted, and only the control steps different from those of the first embodiment will be described herein. Step 420 is different from the corresponding step of the first embodiment. In the second embodiment, the original position of the feed dog 13 is set at the feed end position P11. Accordingly, the step 420 is executed when the feed dog 13 is located below the upper surface of the bed 2, in which the stepping motor 17 is driven so that the output shaft thereof is rotated in the normal direction to advance the feed dog 13, and pulses are distributed until the sector gear 162 is brought into abutment with the stopper 164 (stage C5). Then, after the feed dog 13 has been stopped at the feed limit point PB, at step 422, the stepping motor 17 is excited in the specific excitation mode Ec or Eb corresponding to the position P11 or P10 where the feed dog 13 is moved down below the upper surface of the bed 2. Consequently, the feed dog 13 is positioned accurately at the position P11 or P10 (FIGS. 3 (*b*) and 3 (*d*)) (stage C6).

Figure 13:
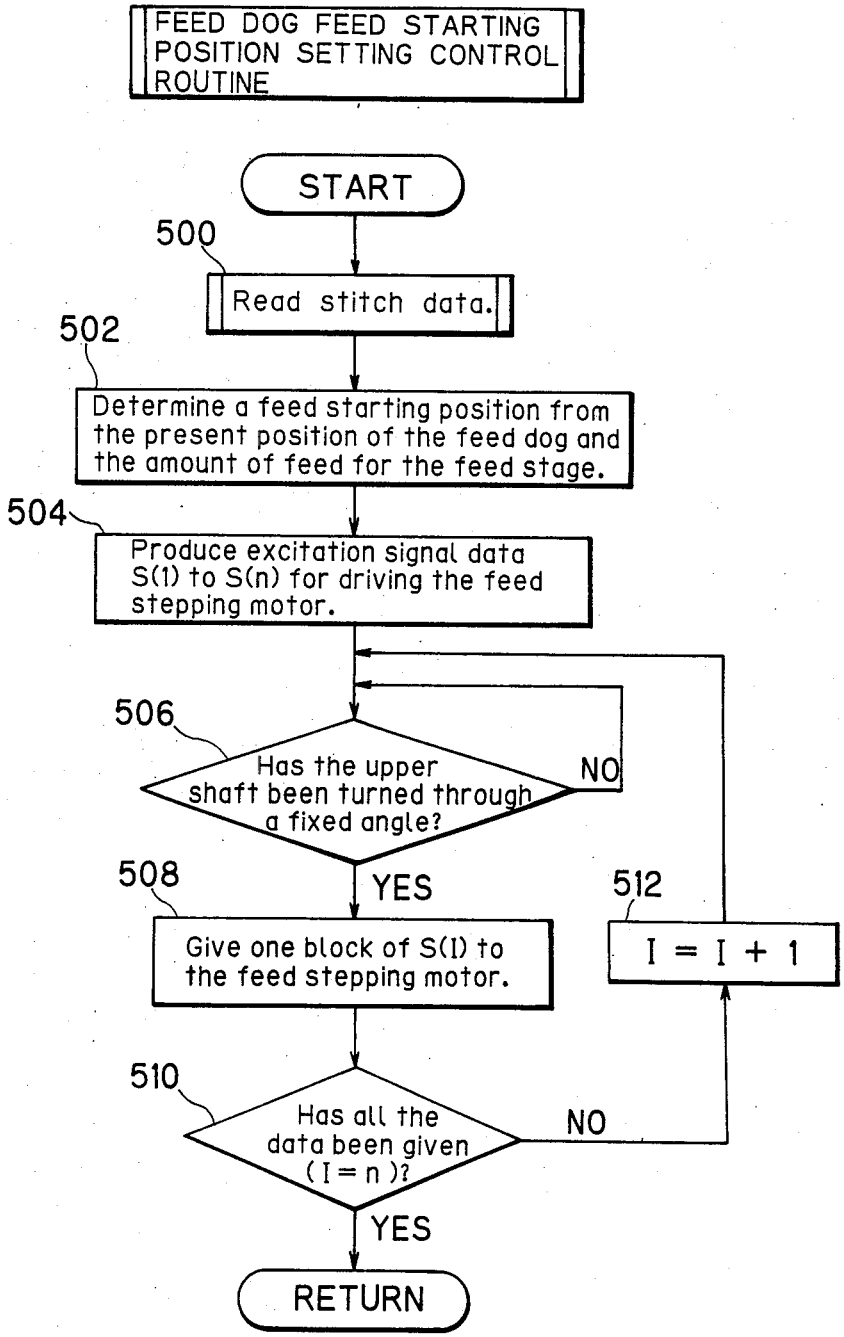

Then, at step 423, a decision is made as to whether or not the output signal TS2 of the timing sensor 55 has risen up or not. Upon the detection of the rise-up of the output signal TS2 (a time t4), a feed start position setting routine shown in FIG. 13 is executed. At step 500, stitch data for the next stitching cycle is read. At step 502, a fed start position required for ending the feed motion when the feed dog 13 is moved to the position P11 is calculated from the present position of the feed dog 13 and the amount of feed for the next stitching cycle. For example, when the feed start position is determined at the position P6, an excitation signal data for exciting the stepping motor 17 to move the feed dog 13 from the present position to the position P6 is produced at step 504. Then, a loop of steps 506, 508 and 510 corresponding to the foregoing needle swinging and feed control steps is executed to position the feed dog 13 at the feed start position (stage C7). Steps 426 and 430 are the same as the steps 420 and 424.

Then, steps 440 to 448 are executed for continuous stitching operation. At the step 440, a decision is made as to whether or not the output signal TS1 of the timing sensor 55 has fallen. Upon the detection of the fall of the output signal TS1 (a time t6), the step 443 for swinging the needle 36 and feeding the fabric is executed to move the feed dog 13 as indicated by stage C8, and the needle 36 is positioned at the predetermined position. Then, the needle 36 is thrusted into the fabric to complete one stitching cycle for forming one stitch. FIG. 16 shows excitation signals for driving the stepping motor 17 and the stepping motor 59 for such a stitching operation. Then, at the step 444 a decision is made as to whether or not the output signal TS2 of the timing sensor 55 has risen up. Upon the detection of the rise-up of the output signal TS2 of the timing sensor 55 (a time t9), the step 446 for positioning the feed dog 13 to the next feed start position is executed (stge C7). The stages C8 and C7 are repeated for continuous stitching operation.

When an excessive load acts on the feed dog 13 in a direction toward the feed limit point PB during stitching operation under such a control mode, the step-out of the stepping motor 17 occurs in stage C8 and the sector gear 162 comes into abutment with the stopper 164 before the completion of pulse distribution for the feed stage, and thereby the feed dog 13 is held at the feed limit point PB. However, according to the present invention, since the stepping motor 17 is excited always in the specific excitation mode Ec at the end of the feed stage C8, the excitation of the stepping motor 17 is started from the specific excitation mode for the return stage C7, in which the feed dog 13 is located below the upper surface of the bed 2 and the same is unloaded, the stepping motor 17 responds to the initial specific excitation mode Ec, and is driven accurately so that the output shaft thereof is turned in the reverse direction from the position P11 corresponding to the specific excitation mode by an angle corresponding to the number of command steps without step-out. Accordingly, the feed start position is always determined accurately, and hence the stepping motor 17 is restored from step-out to synchronism immediately after the removal of the excessive load, to execute the commanded feed stage C8.

A feed device, in a third embodiment, according to the present invention will be described hereinafter. In the third embodiment, shown in FIG. 3 (*e*) a feed stage C22 in which feed operation is started with the stepping motor 17 in the specific excitation mode Ea, and feed stage C24 in which feed operation is ended with the stepping motor 17 in the specific excitation mode Ec are repeated alternately. According to the control routine of the third embodiment, the stepping motor 17 can effectively be restored to synchronism from step-out caused by an excessive load regardless of the direction of action of the excessive load.

Figure 14:
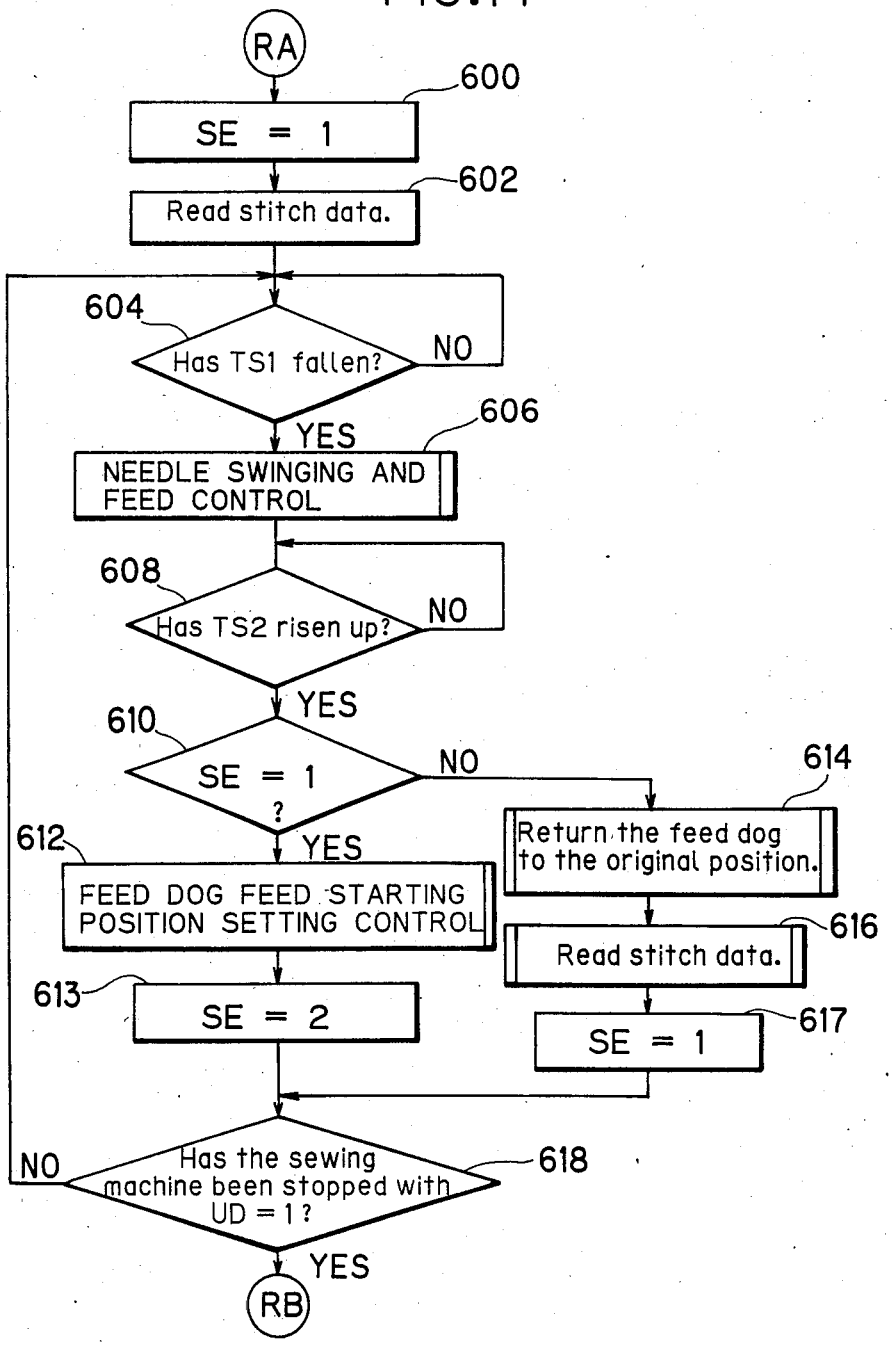
FIG. 14 is a flow chart of a control routine to be executed by a CPU incorporated into a third embodiment of the present invention.

This control routine will be described with reference to flow charts shown in FIGS. 9 and 14. The substitution of the steps between connectors RA and RB of the flow chart shown in FIG. 9 by steps shown in FIG. 14 provides a control routine for the third embodiment.

Step 600 and the following steps constitute a control routine for continuous stitching operation. At step 600, the value of a parameter SE is determined. When the parameter SE is "1", a first stitching cycle in which feed operation is started with the stepping motor 17 in the specific excitation mode Ea is executed. When the parameter SE is "2", a second stitching cycle in which feed operation is ended with the stepping motor 17 in the specific excitation mode Ec is executed. At step 602, stitch data is read. The routine remains in wait state at step 604 until the fall of the output signal TS1 of the timing sensor 55 is detected. Upon the detection of the fall of the output signal TS1 (a time t1), step 606 is executed for needle swinging and feed operation control (FIG. 11). Thus, the feed stage C22 is completed. Then, the routine remains in wait state at step 608 until the rise-up of the output signal TS2 of the timing sensor 55 is detected. Upon the detection of the rise-up of the output signal TS2 (a time t4), a decision is made at step 610 as to the value of the parameter SE. When the parameter SE is "1", the first stitching cycle is completed, and then the routine advances to step 612, where the feed start position setting routine (FIG. 13) is executed to determine a feed start position for the second stitching cycle. Referring to FIGS. 13 and 3 (*e*), the feed dog 13 is located at a position P8 at the present, and stitch data, namely, the number of steps, which being seven herein, for the feed stage C24 of the second stitching cycle is read at step 500. Then, at step 502, the feed start position P4 for the feed stage C24 of the second stitching cycle is determined. At step 504 and the following steps, the feed dog 13 is moved to and positioned at the feed start position P4 while the feed dog 13 is located below the upper surface of the bed 2 (stage C23).

Referring again to FIG. 14, at step 613, the parameter SE is set for "2". Then, at step 618, a decision is made as to whether or not the sewing machine is stopped with the needle 36 at the up position. When the decision at step 618 is NO, the routine returns to the step 604. Then, at step 606, feed operation for the stage C24 of the second stitching cycle is started at a time t6. When it is decided at step 610 that the parameter SE is "2", step 614 is executed from a time t9 after the feed dog 13 has been moved down below the upper surface of the bed 2, to position the feed dog 13 at the original position P1 by driving the stepping motor 17 so that the output shaft thereof is rotated in the reverse direction by ten steps corresponding to the maximum amount of feed of the feed dog 13 (stage C25). Then, at step 616, the next stitch data is read, then the parameter SE is set for "1" at step 617, and then the routine advances to step 618.

Thus, as illustrated in FIG. 3 (*e*), the feed stage C22 of the first stitching cycle in which the feed operation is started with the stepping motor 17 in the specific excitation mode, and the feed stage C24 of the second stitching cycle in which the feed operation is ended with the stepping motor 17 in the specific excitation mode are repeated alternately. The excitation signals for such stitching operation are similar to those shown in FIGS. 15 and 16. As apparent from the description of the first and second embodiments, in the third embodiment, the stepping motor 17 can be restored to synchronism from step-out at least within the following two feed stages and can continue driving the feed dog 13 for feed motion corresponding to the normal commanded number of steps, even when the step-out of the stepping motor 17 is caused by an excessive load acting in a direction toward either the feed limit position PA or PB. Accordingly, the deformation of the pattern attributable to the excessive load is limited to the least extent.

Although the third embodiment has been described as the stepping motor 17 is in the specific excitation mode Ea at the start of feed operation, and the same is in the specific excitation mode Ec at the end of the feed operation, the stepping motor 17 may be in the specific excitation mode Eb both at the start of the feed operation and at the end of the feed operation.

What is claimed is:

1. A feed device for a sewing machine including an endwise reciprocatable needle and feed means having a feed dog and operative to impart a horizontal feed motion and a vertical feed motion to said feed dog in timed relation with the reciprocation of said needle; wherein said feed means comprises, a stepping motor operatively connected with said feed dog for said horizontal feed motion and having excitation modes as many as a predetermined number P, said stepping motor being capable of shifting by a unit amount S when the excitation mode thereof is changed over from one to the next, stopper means disposed at a stoppage position corresponding to at least one of two limit positions defining the maximum range of said horizontal feed motion, and feed control means for controlling said horizontal feed motion by sequentially changing over the excitation modes of said stepping motor in response to signals instructing the feed distance of said feed dog, said feed control means including excitation control means for changing over the excitation mode of said stepping motor to a specific excitation mode at least at one of the start and the end of said horizontal feed motion, said specific excitation mode being predetermined from among the excitation modes to be changed over while said stepping motor shifts by an amount P·S/2 from a position where said stepping motor is positioned when the position of said feed dog is restricted to said stoppage position by said stopper means.

2. A feed device for a sewing machine according to claim 1, wherein said excitation control means changes over the excitation mode of said stepping motor to said specific excitation mode when said feed dog is below the upper surface of the bed of said sewing machine.

3. A feed device for a sewing machine according to claim 1, wherein said excitation control means changes over the excitation mode of said stepping motor to said specific excitation mode in timed relation with every horizontal feed motion.

4. A feed device for a sewing machine according to claim 1, wherein said excitation control means alternately performs the changeover to said specific excitation mode at the start of said horizontal feed motion and the changeover to said excitation mode at the end of said horizontal feed motion.

5. A feed device for a sewing machine including an endwise reciprocatable needle and feed means having a feed dog and operative to impart a horizontal feed motion and a vertical feed motion to said feed dog in timed relation with the reciprocation of said needle; wherein feed means comprises, a stepping motor operatively connected with said feed dog for said horizontal feed motion and having excitation modes as many as a predetermined number P, said stepping motor being capable of shifting by a unit amount S when the excitation mode thereof is changed over from one to the next, a pair of stopper means disposed at a first and a second stoppage position corresponding to two limit positions defining the maximum range of said horizontal feed motion, and feed control means for controlling said horizontal feed motion by sequentially changing over the excitation modes of said stepping motor in response to signals instructing the feed distance of said feed dog, said feed control means including excitation control means for alternately performing the changeover to a first specific excitation mode at the start of said horizontal feed motion and changeover to a second specific excitation mode at the end of said horizontal feed motion, each of said first and second specific excitation modes being predetermined from among the excitation modes to be changed over while said stepping motor shifts by an amount P·S/2 from a position where said stepping motor is positioned when the position of said feed dog is restricted to each of said first and second stoppage positions.

* * * * *